US006363866B1

(12) United States Patent
Schwartz

(10) Patent No.: US 6,363,866 B1
(45) Date of Patent: Apr. 2, 2002

(54) TABLE CONSTRUCTION

(75) Inventor: David L. Schwartz, Creve Couer, MO (US)

(73) Assignee: HOU Technology Inc., Muscatine, IA (US)

( * ) Notice: Subject to any disclaimer, the term of this patent is extended or adjusted under 35 U.S.C. 154(b) by 0 days.

(21) Appl. No.: 09/488,610

(22) Filed: Jan. 20, 2000

(51) Int. Cl.[7] ..... A47B 57/00
(52) U.S. Cl. ..... 108/64; 108/66
(58) Field of Search ..... 108/64, 65, 66, 108/69

(56) References Cited

U.S. PATENT DOCUMENTS

| | | | | |
|---|---|---|---|---|
| 2,705,179 A | * | 3/1955 | Hodgin | 108/64 X |
| 3,053,598 A | | 9/1962 | Cheslow | 108/64 |
| 4,878,439 A | | 11/1989 | Samson | 108/64 X |
| D352,853 S | | 11/1994 | Hosoe | |
| 5,485,795 A | | 1/1996 | Williams | 108/64 X |
| D383,924 S | | 9/1997 | Dormon et al. | |
| 5,676,068 A | | 10/1997 | Kallander | |
| D388,639 S | | 1/1998 | Dormon et al. | |
| D390,381 S | | 2/1998 | Dormon et al. | |
| 5,967,058 A | * | 10/1999 | Ambrose et al. | 108/64 |

FOREIGN PATENT DOCUMENTS

| | | | |
|---|---|---|---|
| DK | 82329 | * 11/1956 | 108/64 |
| FR | 1101580 | * 10/1955 | 108/64 |
| FR | 2230156 | * 12/1974 | 108/64 |
| FR | 2300521 | * 10/1976 | 108/64 |

* cited by examiner

*Primary Examiner*—Jose V. Chen
(74) *Attorney, Agent, or Firm*—Jones, Day, Reavis & Pogue

(57) ABSTRACT

A table is provided having a table top with two opposed side edges and two opposed end edges. The side edges are curvilinear each having a concave portion and a convex portion. The side edges are further mutually aligned so as to be a constant distance from one another along their respective lengths. One end edge is concave and the other end edge is convex. The concave end edge has a shape that is complimentary to the shape of the convex side edge portions and the convex end edge has a shape that is complimentary to the shape of the concave side edge portion. Thus, multiple like tables of the foregoing configuration may be arranged together in a variety of aesthetically pleasing and highly functional assemblies.

4 Claims, 2 Drawing Sheets

TABLE CONSTRUCTION

BACKGROUND OF THE INVENTION

1. Field of the Invention

The present invention relates generally to the construction of tables and, more particularly, to a specific shape of table having the capability of being arranged with other like tables to create assemblies of tables having increased functional size.

2. Description of the Related Art

Tables of a type used in conference settings such as hotel or office meeting rooms are frequently modular in the sense that multiple tables can be positioned together in an assembly which meets the size requirements of the particular meeting event. Such modularity allows the tables to be moved about with ordinary effort and permits the individual tables to pass through doorways or other room access openings. Typically, such tables have tops or work surfaces that are square or rectangular in shape. These shapes allow multiple tables to be arranged in elongated assemblies or U-shaped or L-shaped assemblies, for example, depending on the particular needs of the meeting event.

The standard square or rectangular table for use in conference or meeting settings, while often quite functional, is lacking in aesthetic appeal where some business people are concerned. Thus, in recent times, designers of tables for use in more upscale office environments have attempted to depart from traditional table design and construct tables having a more interesting modern shape. To this end tables are now available having curvilinear edges which present an aesthetically pleasing look and are, at the same time, quite functional. An example of such a table is shown in Dormon et al., U.S. Pat. No. D-390,381, issued Feb. 10, 1998. Dormon et al. teach a table design having a generally elongate top with sides having curvilinear edges defining mutually-aligned gentle reverse S-shaped contours. The ends of the table are straight. It thus seems apparent that multiple tables of this shape can be arranged end-to-end or side-by-side to create larger table assemblies if desired. However, such assemblies appear to be limited just to the foregoing arrangements.

In another form of table construction as disclosed in U.S. Pat. No. 5,676,068, issued to Kallander on Oct. 14, 1997, a shape of table top is shown which has somewhat of a teardrop configuration. Further, multiple tables of this configuration are intended to be arranged in edge contact with one another to form a curved or looped assembly. While such a construction might satisfy the aesthetic interests of some, it seems apparent that it offers only limited functionality where traditional notions of acceptable meeting room accommodations are concerned. Thus, such a construction has limited applicability in practical meeting room settings.

Accordingly, it is desirable to provide a table suitable for use in conference settings which can be arranged with other like tables to create an enlarged work surface assembly. It is further desirable to provide such a table having curvilinear edges that presents a uniquely attractive aesthetic appearance as compared to traditional rectangular or square straight-edged tables. Still further, it is desirable to provide such a table having the capability of being arranged with other like tables in a variety of assembled configurations depending upon the particular seating requirements of a given meeting space or the preferences of the users.

SUMMARY OF THE INVENTION

The present invention improves over the prior art by providing a table having a table top with two opposed side edges and two opposed end edges. The side edges are curvilinear each having a concave portion and a convex portion. The side edges are further mutually aligned so as to be a constant distance from one another along their respective lengths. One end edge is concave and the other end edge is convex. The concave end edge has a shape that is complimentary to the shape of the convex side edge portions and the convex end edge has a shape that is complimentary to the shape of the concave side edge portion. Thus, multiple like tables of the foregoing configuration may be arranged together in a variety of aesthetically pleasing and highly functional assemblies.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
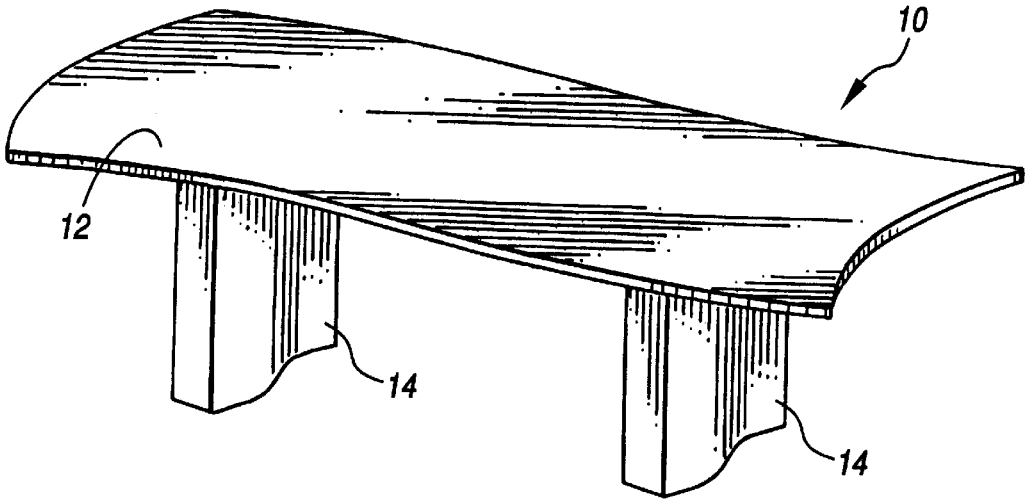
FIG. 1 is a side perspective view of a table constructed in accordance with the principles of the invention.

Referring now to the drawings, and initially to FIG. 1, an exemplary table constructed according to the principles of the invention is designated generally by the reference numeral 10. The illustrated table 10 includes a table top 12 as will be described in detail hereinafter and a pair of supporting pedestals 14. It will be appreciated that the invention is not limited to a construction including the specific pedestals 14 illustrated. Essentially, any known construction for supporting the table top 12 may be used such as a single center pedestal or a plurality of legs, for example.

Figure 2:
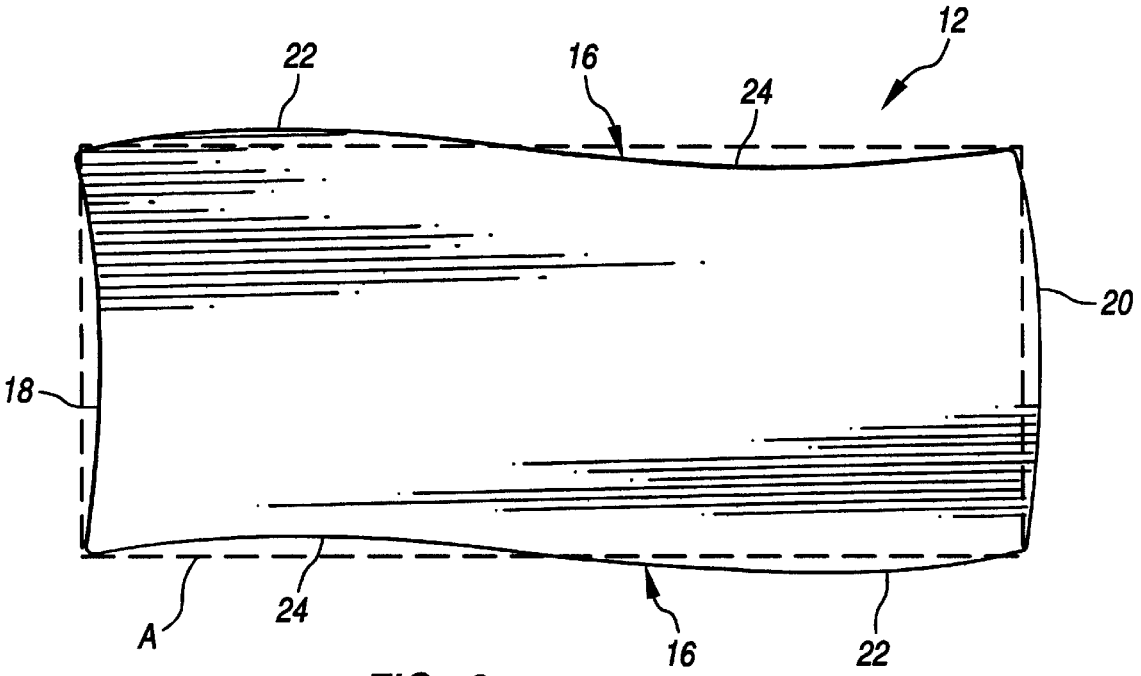
FIG. 2 is a top plan view of a table top constructed according to the invention.

Turning now to FIG. 2, the table top 12 is shown in plan view. Generally, the top 12 is elongate having opposed side edges 16 and opposed end edges 18 and 20. The side edges 16 are curvilinear defining gentle reverse S-like shapes each having a convex portion 22 and a concave portion 24. The edges 16 are mutually aligned so as to be a constant distance from one another along their respective lengths. A first end edge 18 of the top 12 is generally concave while the opposed end edge 20 is generally convex. Significantly, the contour or shape of the concave end edge 18 is complementary to the contour or shape of the convex side edge portion 22 such as to mate with the portion 22 when a second like top 12 is placed in abutting edgewise relation thereto. Correspondingly, the contour or shape of the convex end edge 20 is complementary to the contour or shape of the concave side edge portion 24 such as to mate with the portion 24 when a second like top 12 is placed in abutting edgewise relation thereto. The shape of the end edge 18 and end edge 20 are also complementary to each other so as to mate with each other when two like tops 12 are placed in abutting end-to-end edgewise relation. The convex side edge portions 22 are also approximately the same arcuate length as the length of the concave side edge portions 24 and the side edge portions 22 and 24 are substantially the reverse image of each other when viewed in plan. The specific alignment of the side edges 16 and end edges 18 and 20 is such that imaginary lines connecting the four corners of the table top 12 define a rectangle A.

Figure 3:
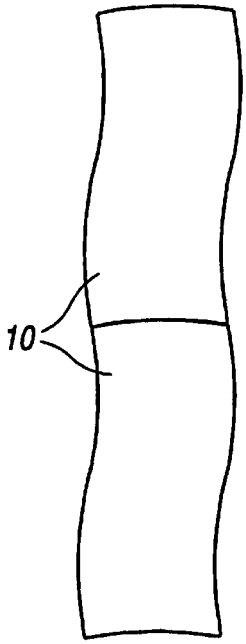
FIG. 3–7 illustrate plan views of various assembled arrangements of like tables constructed according to the invention.
Figure 4:
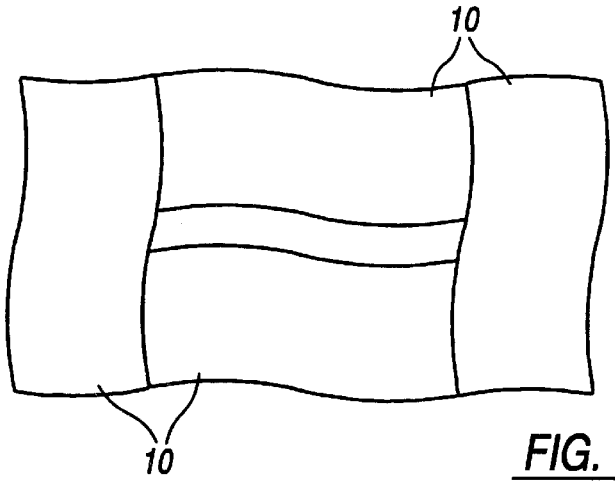
Figure 5:
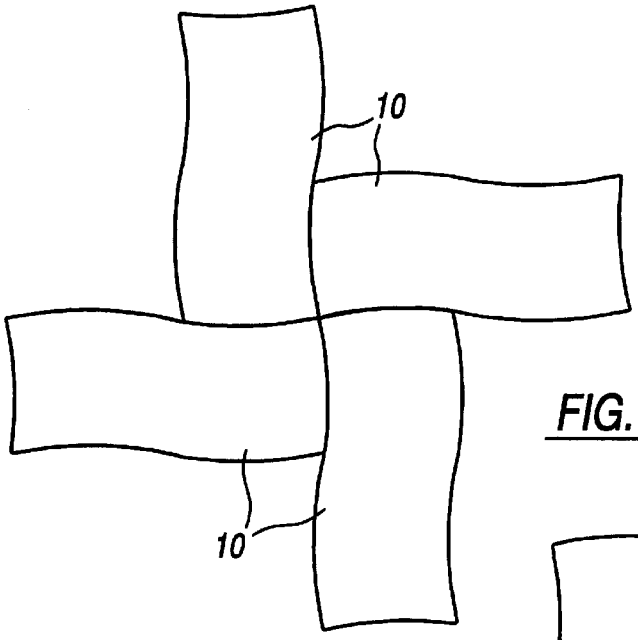
Figure 6:
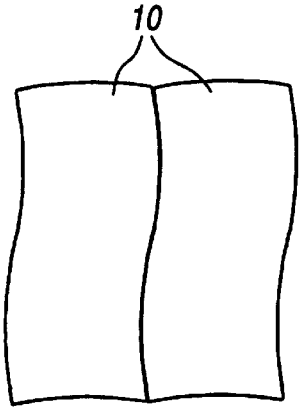
Figure 7:
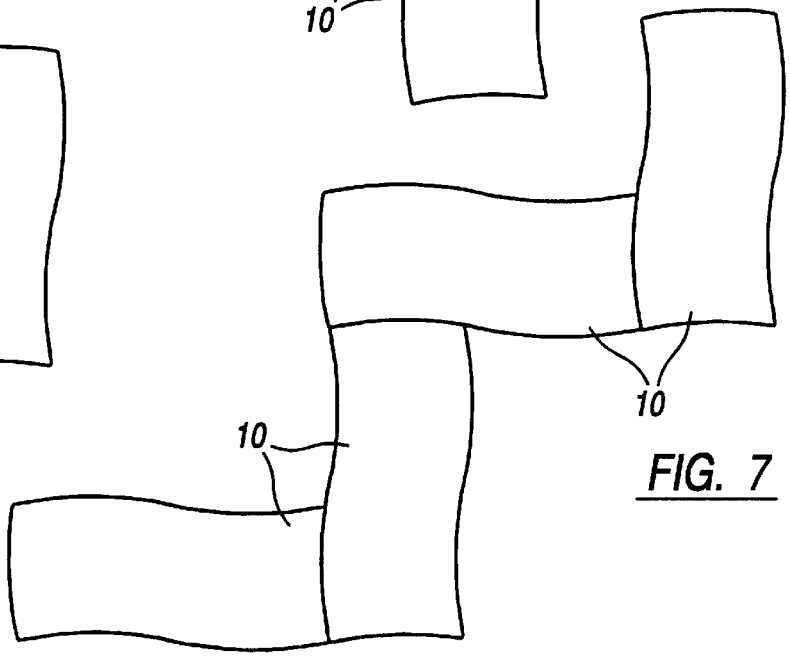

With reference to FIGS. 3–7, it can be appreciated that a variety of different assembled configurations are possible for like tables 10 constructed as described. Where an elongated assembly is desired, two or more tables 10 may be arranged in end-to-end relation as illustrated in FIG. 3. If a relatively large conference-like arrangement is desired, four tables 10 may be arranged as shown in FIG. 4. A star-like arrangement as shown in FIG. 5 using four tables 10. Of course, because of the complementary nature of the side edges 16 of the top 12, two or more tables 10 may be arranged in abutting side-by-side relation as shown in FIG. 6. Further, a W-like arrangement is possible as shown in FIG. 7.

It can now be appreciated that a table 10 constructed with the novel shape of top 12 offers considerable aesthetically pleasing while functional possibilities for use in conference or other meeting settings, particularly where it is necessary to accommodate large numbers of people. Individual tables 10 as illustrated in FIGS. 3–7, may be arranged in a variety of configurations to meet the particular needs of a meeting event or the space requirements of the associated room. While FIGS. 3–7 show only five examples of possible table 10 arrangements, it will be understood that the possibilities for other arrangements are essentially limitless. Further, the table 10 can be readily constructed by known methods using conventional materials typically used in the present construction of traditional conference-like tables. It should be understood that while the table top 12 has been shown with gentle "reverse" S-like side edges 16, another form of the invention might readily be a table top having gentle S-like side edges.

While the present invention has been described in connection with preferred embodiments thereof, it will be apparent to those skilled in the art that many changes and modifications may be made without departing from the spirit and scope of the present invention. Accordingly, it is intended by the appended claims to cover all such changes and modifications as come within the spirit and scope of the invention.

I claim:

1. A table comprising:

a table top having two opposed side edges and two opposed end edges;

said side edges each being curvilinear having a concave portion and a convex portion and being mutually aligned so as to be a constant distance from one another along their respective lengths;

a first end edge being generally concave; and the second end edge being generally convex;

wherein the concave first end edge has a shape that is complementary to the shape of the convex side edge portions and the convex second end edge has a shape that is complementary to the shape of the concave side edge portions, and wherein the concave first end edge has a shape that is complementary to the shape of the convex second end edge.

2. The table of claim 1 wherein the concave side edge portions are approximately the same length as the length of the convex side edge portions.

3. The table of claim 1 wherein the concave side edge portions are substantially the reverse image of the convex side edge portions in plan view.

4. The table of claim 1 wherein said side edges and end edges define four corners and said corners when connected by imaginary lines around the periphery of the table top define a rectangle.

* * * * *

UNITED STATES PATENT AND TRADEMARK OFFICE

CERTIFICATE OF CORRECTION

PATENT NO. : 6,363,866 B1
DATED : April 2, 2002
INVENTOR(S) : David L. Schwartz

It is certified that error appears in the above-identified patent and that said Letters Patent is hereby corrected as shown below:

Title page,
Item [73], Assignee, change "HOU" to -- HON --.

Signed and Sealed this

Third Day of September, 2002

*Attest:*

*Attesting Officer*

JAMES E. ROGAN
*Director of the United States Patent and Trademark Office*